US011920279B2

(12) United States Patent
Stücheli et al.

(10) Patent No.: US 11,920,279 B2
(45) Date of Patent: Mar. 5, 2024

(54) WASHING MACHINE

(71) Applicant: Electrolux Professional AB (PUBL), Stockholm (SE)

(72) Inventors: Marius Stücheli, Stockholm (SE); Mattias Johansson, Stockholm (SE); Lars Andersson, Stockholm (SE)

(73) Assignee: Electrolux Professional AB, Stockholm (SE)

( * ) Notice: Subject to any disclaimer, the term of this patent is extended or adjusted under 35 U.S.C. 154(b) by 119 days.

(21) Appl. No.: 17/056,754

(22) PCT Filed: May 25, 2018

(86) PCT No.: PCT/EP2018/063764

§ 371 (c)(1),
(2) Date: Nov. 18, 2020

(87) PCT Pub. No.: WO2019/223877

PCT Pub. Date: Nov. 28, 2019

(65) Prior Publication Data

US 2021/0207308 A1 Jul. 8, 2021

(51) Int. Cl.
*D06F 37/26* (2006.01)
*D06F 21/02* (2006.01)
(Continued)

(52) U.S. Cl.
CPC ..... *D06F 37/268* (2013.01); *D06F 21/02* (2013.01); *D06F 34/18* (2020.02); *D06F 37/28* (2013.01)

(58) Field of Classification Search
CPC ..... D06F 34/18; D06F 21/02; D06F 37/268; D06F 37/28
See application file for complete search history.

(56) References Cited

U.S. PATENT DOCUMENTS

2009/0121594 A1* 5/2009 Sans Rovira ..... D06F 37/22 248/346.03
2011/0127091 A1* 6/2011 Shepherdson ..... G01G 3/08 177/211
(Continued)

FOREIGN PATENT DOCUMENTS

CN 101736565 6/2010
CN 104452183 3/2015
(Continued)

OTHER PUBLICATIONS

Office action in counterapart Japan application No. 2020-564848 dated Feb. 22, 2022, 4 pages (English Translation).
(Continued)

*Primary Examiner* — Joseph L. Perrin
(74) *Attorney, Agent, or Firm* — Pearne & Gordon LLP

(57) ABSTRACT

The present disclosure relates to a laundry washing machine, comprising a rotatable drum (3), a suspension arrangement (29, 31) carrying the drum in relation to a base structure (7) located under the washing machine on which the washing machine rests, and a load sensing device (9), configured to sense the load of the drum (3). A first structural element (11) extends in a first plane and is connected to either of the drum and the suspension arrangement, and a second structural element (13) extends in a second plane, parallel with the first plane, and is connected to the other of the drum and the suspension arrangement. The load sensing device is attached to the second structural element on a surface thereof facing away from the first structural element and is connected to the first structural element. This allows for a compact load sensing arrangement.

11 Claims, 4 Drawing Sheets

(51) Int. Cl.
*D06F 34/18* (2020.01)
*D06F 37/28* (2006.01)

(56) References Cited

U.S. PATENT DOCUMENTS

| | | | | |
|---|---|---|---|---|
| 2016/0215437 | A1* | 7/2016 | Jackson | D06F 39/125 |
| 2018/0073180 | A1* | 3/2018 | Jo | D06F 37/10 |

FOREIGN PATENT DOCUMENTS

| | | |
|---|---|---|
| CN | 107692944 | 2/2018 |
| EP | 1295978 | 3/2003 |
| EP | 1849905 | 10/2007 |
| EP | 3222768 | 9/2017 |
| JP | 2003093790 | 4/2003 |
| JP | 2004353749 | 12/2004 |
| WO | 2010133510 | 11/2010 |
| WO | 2012089442 | 7/2012 |
| WO | 2014098626 | 6/2014 |

OTHER PUBLICATIONS

International Search Report and Written Opinion for PCT/EP2018/063764, dated Feb. 12, 2019, 9 pages.
European Communication for application No. 18728088.8 dated Apr. 14, 2023, 5 pages.
English translation of Chinese OA for app No. 201880093579.7 dated Jun. 15, 2022, 9 pages.
English translation of Korean OA for app No. 1020207036658 dated May 22, 2022, 3 pages.
English translation of Korean OA for app No. 1020207036658 dated Nov. 29, 2022, 2 pages.
English translation of Chinese OA for app No. 201880093579.7 dated Nov. 16, 2022, 5 pages.
English translation of Chinese OA for app No. 201880093579.7 dated Apr. 5, 2023, 4 pages.
English translation of Chinese OA for app No. 201880093579.7 dated Aug. 25, 2023, 4 pages.

* cited by examiner

WASHING MACHINE

FIELD OF THE INVENTION

The present disclosure relates to a laundry washing machine comprising a rotatable drum, a suspension arrangement carrying the drum in relation to a base structure located under the washing machine and on which the washing machine rests, and a load sensing device, configured to sense the load of the drum.

TECHNICAL BACKGROUND

Such a washing machine is disclosed for instance in WO-2012/089442-A1 where load cells are located in a frame in the bottom of the machine. Such load cells can be used to weigh the amount of laundry loaded into the drum, allowing the washing cycle to be adapted thereto.

One problem associated with washing machines of this type is how to make the machine capable of carrying out a more adaptable washing cycle that is more efficient.

SUMMARY OF THE INVENTION

One object of the present disclosure is therefore to provide a washing machine with a load sensor that provides more versatile data.

This object is achieved by means of a washing machine as defined in claim 1. More particularly, in a washing machine of the initially mentioned kind, there is provided a first structural element, which is connected to either of the drum and the suspension arrangement, and a second structural element which is connected to the other of the drum and the suspension arrangement. The first and second structural elements extend in first and second planes, respectively, which are mutually parallel. Further, the load sensing device, which may typically be a planar beam load cell, is attached to the second structural element on a surface thereof facing away from the first structural element and is connected to the first structural element.

This allows a very compact arrangement, as there is only needed a small gap between the first and second structural elements, which is bridged by the load sensor. The load sensing arrangement is nevertheless capable of measuring the load in between the drum and the suspension arrangement which provides improved load sensing data, which may be used for a more adaptive control of the washing machine.

The second structural element may comprise an opening, and the load sensing device may be connected to the first structural element through the opening. This allows the first and second structural elements to be connected to each other via the load sensing device, without the latter being mounted between the first and second structural elements.

The load sensing device may be attached to the second structural element by means of an attachment part such as an attachment plate, which is attached to the second structural element on a surface thereof facing towards the first structural element. This provides a firm attachment point on the second structural element even if this element consists of a relatively thin metal plate.

There may be provided an opening in the first structural element which at least partly accommodates the attachment part. This allows the first and second structural elements to be located very close to each other without the attachment part touching the first structural element. The attachment part may be positioned in a stamped recess in the second structural element to offset the load sensing device slightly from the remainder of the second structural element to facilitate the load sensing device's bending, slightly towards the latter.

There is provided three or more sensing devices in between the suspension arrangement and the drum.

The sensing device may be a planar beam load cell, although other load sensing devices are conceivable in this context.

There is provided a door for gaining access to the interior of the drum, and the door is suspended by the suspension arrangement. This may be achieved for instance by attaching the door to a housing, which contains the rotatable drum and is carried via the sensing arrangement. This means that no connections, by bellows or the like, between suspended and non-suspended parts are needed to arrange the door, which reduces disturbances on the load measuring.

The present disclosure also considers a laundry washing machine comprising a rotatable drum, a suspension arrangement carrying the drum in relation to a base structure, located under the washing machine and on which the washing machine rests, and a load sensing device, configured to sense the load of the drum. A first structural element is connected to the drum, and a second structural element is connected to the suspension arrangement. The load sensing device is fitted between first structural element and the second structural element.

Further, the present disclosure considers a laundry washing machine comprising a rotatable drum, a suspension arrangement carrying the drum in relation to a base structure located under the washing machine on which the washing machine rests, and a load sensing device, configured to sense the load of the drum. The load sensing device is located on the opposite side of the suspension arrangement as seen from the support structure.

DETAILED DESCRIPTION

Figure 1:
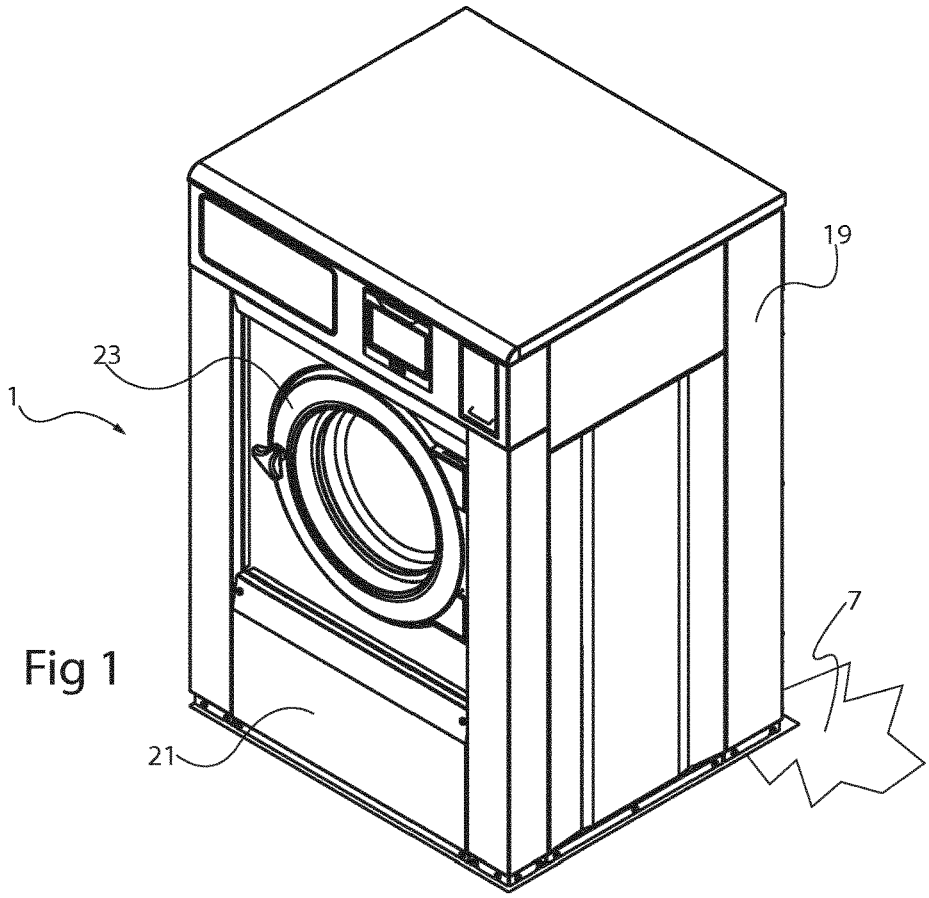
FIG. 1 shows a perspective view of a washing machine.

The present disclosure relates generally to a washing machine 1, an example of which is shown in FIG. 1. The washing machine comprises an outer housing 19 and rests on a base structure 7, which is typically a floor, but in principle could be a rack or another machine, for instance. At a front side 21 of the washing machine, there is located a door 23 through which the interior of a drum is accessible.

Figure 2:
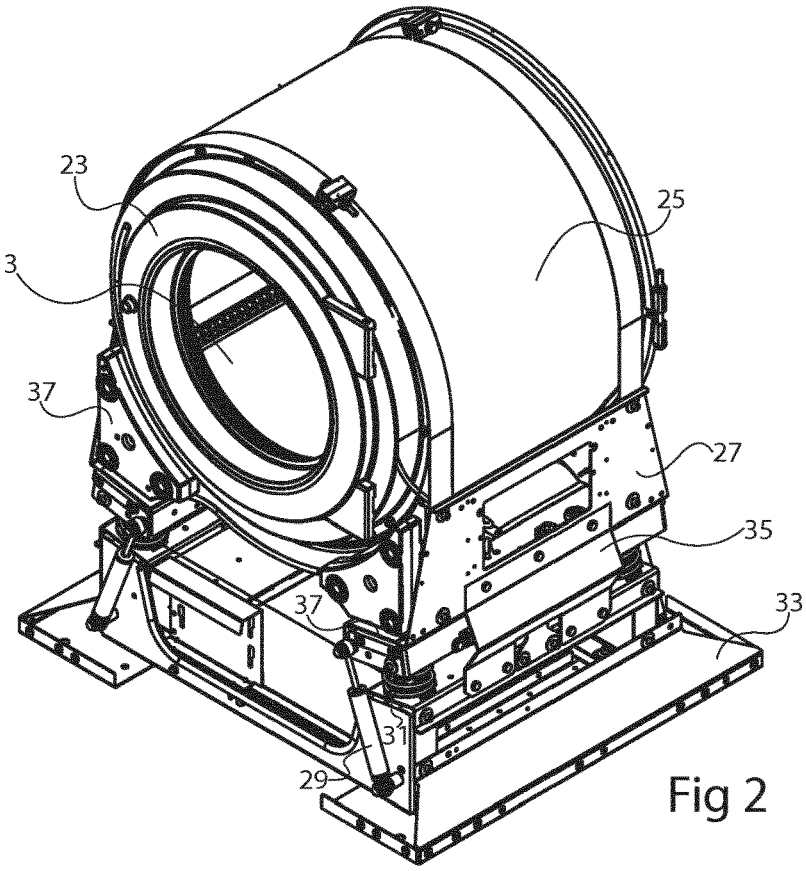
FIG. 2 shows a perspective view of suspension arrangement carrying a drum.

FIG. 2 shows a suspension arrangement carrying a rotatable drum 3 inside the housing 19 of FIG. 1. The rotatable drum 3 is located inside a typically cylindrical housing 25, which is carried by a drum cradle arrangement 27, which in turn is carried by a suspension arrangement 29, 31, comprising dampers 29 and springs 31 connecting the cradle arrangement to a bottom part 33 of the machine that rests on the base structure/floor 7. Typically, one damper/spring combination is used in each corner.

As illustrated, at delivery, the cradle arrangement 27 may be firmly connected to the bottom part 33 by means of transport lock plates 35, which are removed before the washing machine is used.

Weights 37 may be added to the cradle arrangement to obtain suitable spring-mass system properties.

As shown, the door 23, used for gaining access to the interior of the drum 3, may be suspended by the suspension arrangement, i.e. is attached to the cylindrical housing 25 in which the rotatable drum 3 moves, rather than to the outer housing 19 of the machine. This means that there is one fewer part disturbing the collecting of load data, as will be described. If instead a door for instance would be attached to the outer housing 19 providing an opening that is connected to the cylindrical housing 25 by means of a bellow, that connection between a part suspended by the suspension arrangement and a non-suspended part would impair the load measurements as some load would be carried via the bellow rather than via the load sensors.

Figure 3:
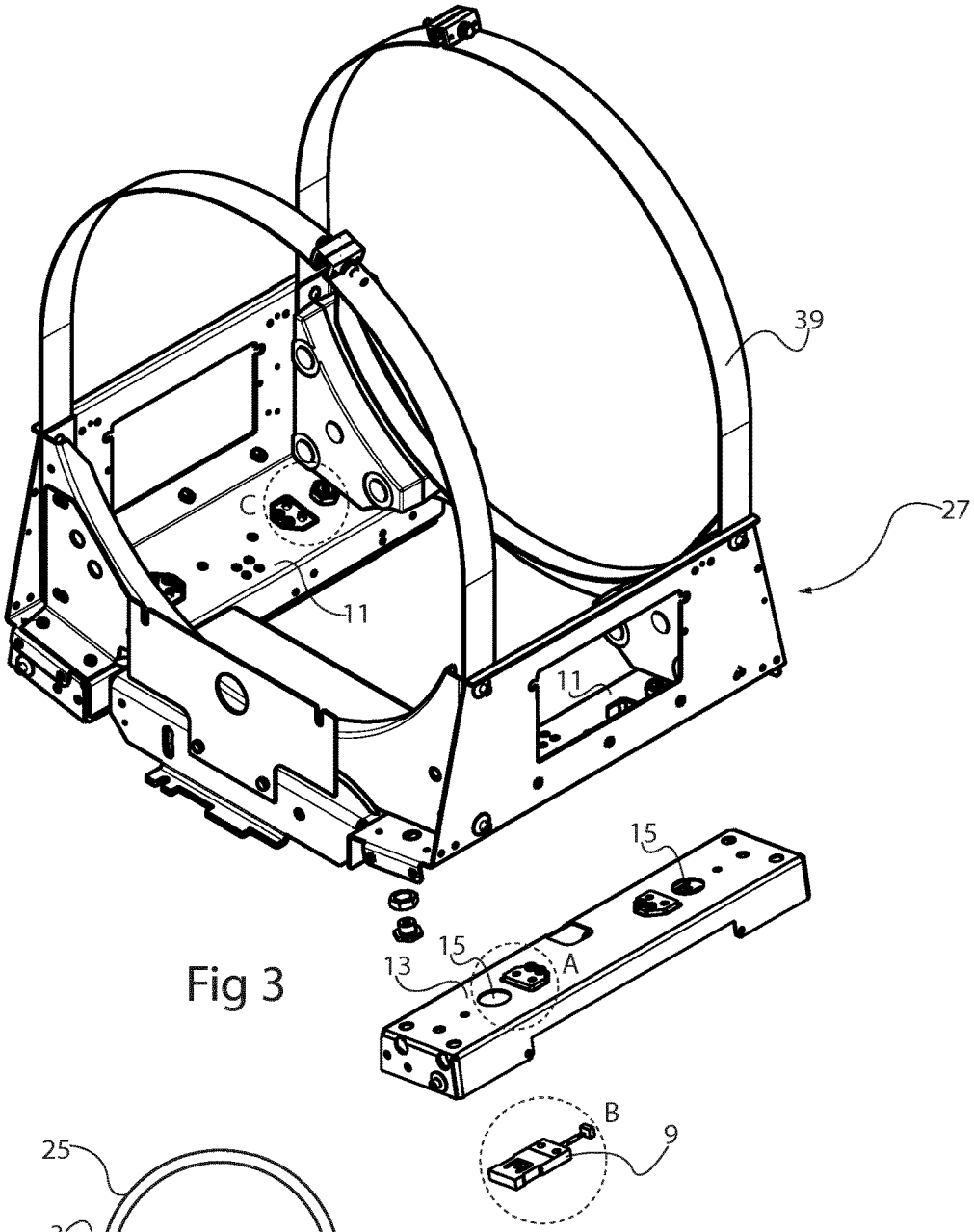
FIG. 3 shows a partially exploded view of a drum cradle in the suspension arrangement of FIG. 2.

FIG. 3 shows a partially exploded view of a drum cradle in the suspension arrangement of FIG. 2. As shown, there is on each side provided a first structural element 11 which is connected to the drum of the machine, which is kept in place by bands 39. The first structural element 11 may as shown be in the form of a sheet metal plate, which substantially extends in a first plane in a first portion although it may be bent to form other parts of the cradle.

There is provided, as shown in the exploded view on the right side, a second structural element 13, which is connected to the suspension arrangement (29, 31 cf. FIG. 2). The second structural element 13 may as well be in the form of a sheet metal plate, and this plate may substantially extend in a second plane, which is parallel with the first plane, i.e. the plane of the first structural element 11, at a location where they are interconnected as will be shown.

The first and second structural elements 11, 13 are interconnected by means of load sensors 9 that together sense the load on the drum. There is thus provided a gap between the first and second structural elements 11, 13 which is bridged by the load sensors 9. Typically, three or more such load sensors 9 are used, in the illustrated case four arranged in corners of a rectangle as seen from the top of the washing machine.

As this sensing is done on the drum's 3 side of the suspension arrangement 29, 31, more information about the drum's dynamic load is included in the obtained data as this is not blurred by an intervening suspension arrangement. This allows the machine of being very precisely controlled for instance during a centrifuge process to achieve improved operation.

Figure 4:
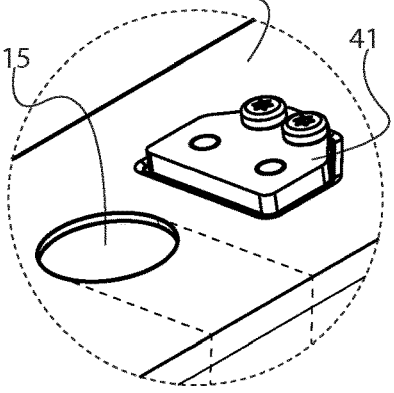
FIGS. 4-6 show enlarged portions A, B, and C of FIG. 3.
Figure 5:
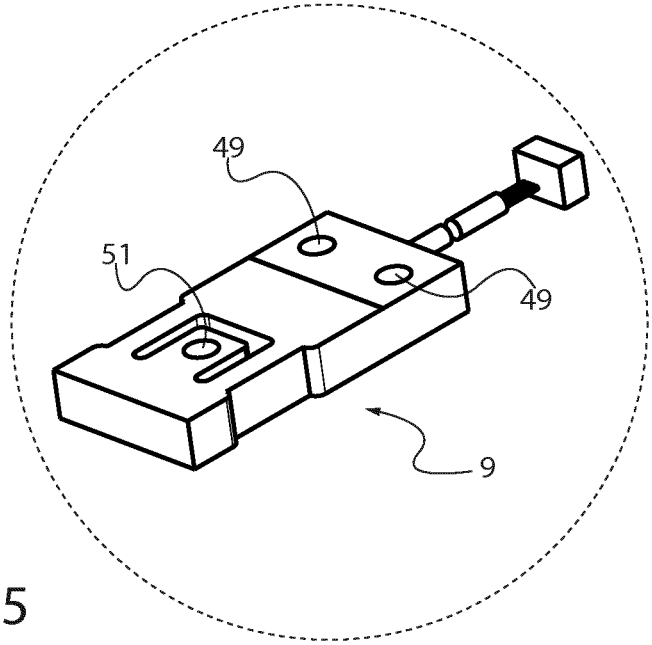
Figure 6:
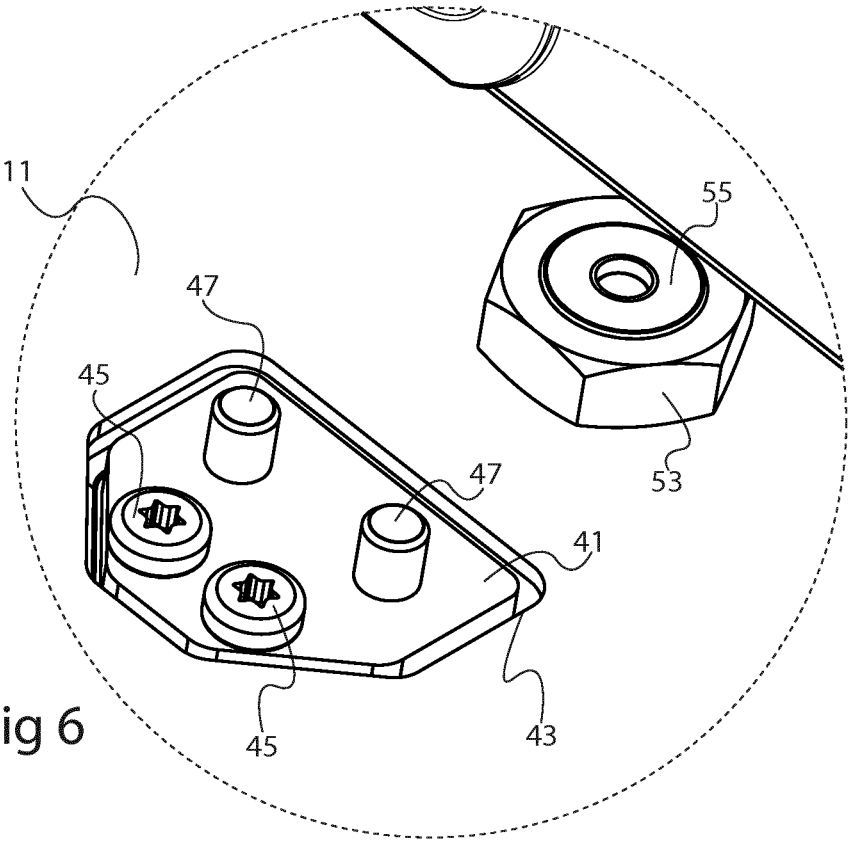

FIGS. 4-6 show enlarged portions A, B, and C of FIG. 3. To start with, the arrangement used to attach the load sensor 9 to the second structural element 13 is shown in FIG. 4. The second structural element 13 comprises an opening in the form of a hole 15, through which the load sensor can connect to the first structural element 11. In the illustrated case, the opening is a hole in the second structural element 13, although in principle there could also be provided a cut-out from the edge of the first structural element 11 as indicated with dashed lines. In principle there could also be provided an arrangement that connects the load sensor to the first structural element around the side edge of the first structural element 13. It should be noted though, that the illustrated embodiment with a hole 15 in the sheet metal plate forming the first structural element allows a both strong and compact connecting arrangement.

As the load sensor 9 will be required to take up significant loads it should be firmly connected to the second structural element 13. In order to avoid using a thick sheet metal piece to form the second structural element 13, there may be provided an attachment part e.g. in the form of an attachment plate 41 on the side of the second structural element which faces the first structural element. This allows the load sensor 9 to be firmly connected to the second structural element 13 without making the latter flex significantly at this point.

As shown in FIG. 6, there may be arranged an opening 43 in the first structural element 11 which at least partly accommodates this attachment plate 41. The opening 43 is slightly wider than the extensions of the plate to allow some movement between the structural elements. This arrangement allows the first and second structural elements 11, 13 to be placed very close to each other without interfering with the measuring carried out by the load sensors. The attachment plate 41 may be attached to the second structural element 13 by means of a first set of bolts 45 or by means e.g. of welding, and the load sensor may in turn be attached to the attachment plate 41 by means of a second set of bolts, through the second structural element.

The load sensor, shown in FIG. 5, may be a planar beam load cell 9, and may comprise threaded openings 49 for the bolts 47, indicated in FIG. 6 and connecting to the second structural element 13, as well as an opening 51, which by means of a bolt (57, cf. FIG. 8) is connected to a nut and bolt configuration 53, 55, being firmly attached to the first structural element 11. Other load sensors than planar beam load cells are conceivable in this context as is known to the skilled person, for instance a piezo electric cell could be located in between the first and second structural elements 11, 13.

Figure 7:
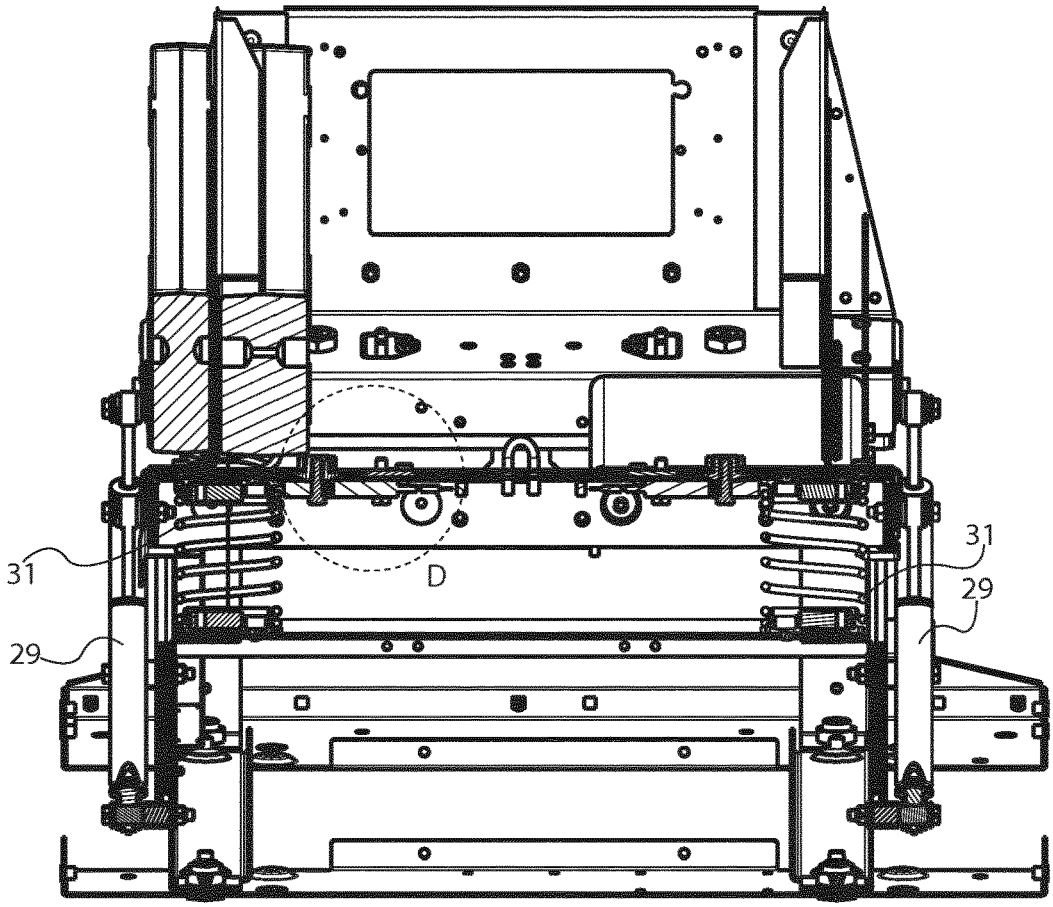
FIG. 7 shows a cross-section through a suspension arrangement as illustrated in FIG. 2 and as seen from the side of the washing machine.

FIG. 7 shows a cross-section through the suspension arrangement 29, 31 as illustrated in FIG. 2 and as seen from the side of the washing machine.

Figure 8:
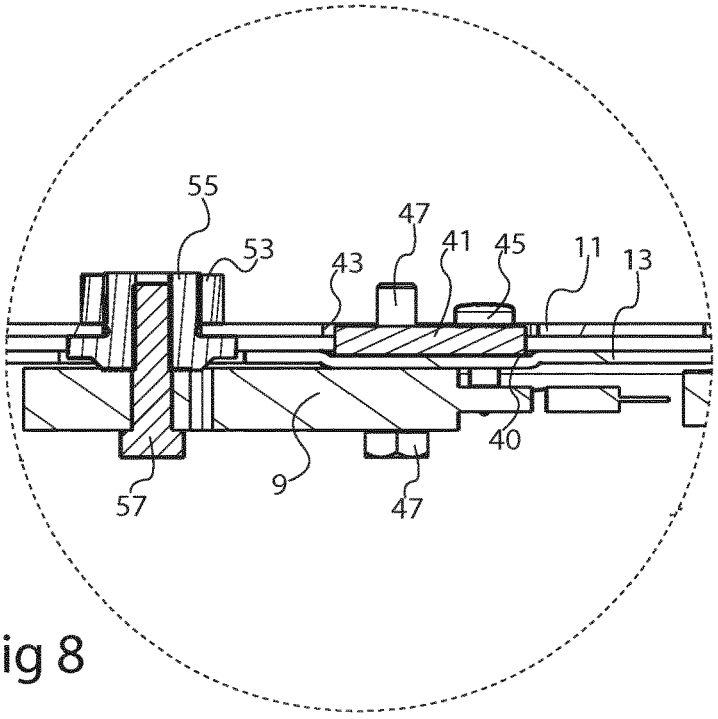
FIG. 8 shows enlarged portion D of FIG. 7.

FIG. 8 shows enlarged the portion D of FIG. 7, which illustrates a load sensor 9 in the form of a planar load cell connecting a first structural element 11, in the form of a sheet metal plate, to a second structural element 13, also in the form of a sheet metal plate. As shown, the load sensor 9 is attached to the second structural element 13 by means of an attachment plate 41 on the opposite side of the second structural element 13. There may be formed a stamped recess 40 in the plate forming the second structural element 13 at the location of the attachment plate 41 such that the load sensor 9 is slightly offset from the second structural element 13, except where attached thereto. This allows the load sensor to flex towards the second structural element 13 even if being flat. This offset could also be achieved also with another attachment plate, on the load sensor's side.

The attachment plate 41 is screwed to the second structural element 13 by means of bolts 45, and the load sensor 9 is attached, at one end, to the attachment plate 41 and the structural element by means of another set of bolts 47. As can be seen, the attachment plate 41 reaches into an opening 43 in the first structural element 11 to allow the structural elements to be placed closer to one another. This opening 43 is slightly bigger than the plate 41, such that that the latter can move slightly without touching the first structural element 11.

The other end of the load sensor 9 is connected to a bolt and screw combination 53, 55, which is attached to the first structural element 11 by clasping the rim of an opening therein. The load sensor 9 is attached thereto by means of a bolt 57 which is screwed into a threaded opening in the bolt 53 attached to the first structural element 11.

Figure 9:
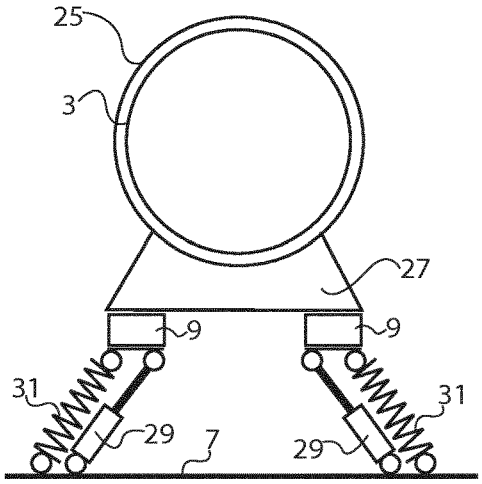
FIG. 9 schematically shows a washing machine having load sensors arranged on the drum's side of a suspension arrangement.

FIG. 9 schematically shows a washing machine having load sensors arranged on the drum's side of a suspension arrangement. Thus, in a laundry washing machine comprising a rotatable drum 3, a suspension arrangement 29, 31 carries the drum in relation to a base structure 7 located under the washing machine on which the washing machine rests. A load sensing device 9, configured to sense the load of the drum 3 is provided. The load sensing device 9 is located on the opposite side of the suspension arrangement 29, 31 as seen from the base structure 7.

The present disclosure is not restricted to the above-described embodiment and may be varied and altered in different ways within the scope of the appended claims.

The invention claimed is:

1. A laundry washing machine comprising:

a cylindrical housing, a rotatable drum located within the cylindrical housing, a suspension arrangement comprising a damper and carrying the cylindrical housing in relation to a base structure located under the washing machine and on which the washing machine is adapted to rest, and a load sensing device configured to sense a load of the drum, a first structural element substantially extending in a first plane and being connected to either of the cylindrical housing or the suspension arrangement, and a second structural element substantially extending in a second plane, which is parallel with the first plane, and being connected to the other of the cylindrical housing or the suspension arrangement, wherein the load sensing device is attached to the second structural element on a surface thereof facing away from the first structural element and is connected to the first structural element, the load sensing device bridging a gap formed between the first and second structural elements.

2. A laundry washing machine according to claim 1, wherein the second structural element comprises an opening, and the load sensing device is connected to the first structural element through the opening.

3. A laundry washing machine according to claim 1, wherein the load sensing device is attached to the second structural element by an attachment part, which is attached to the second structural element on a surface thereof facing towards the first structural element.

4. A laundry washing machine according to claim 3, said attachment part comprising an attachment plate, wherein there is arranged an opening in the first structural element which at least partly accommodates the attachment plate.

5. A laundry washing machine according to claim 3, wherein the attachment part comprises an attachment plate positioned in a stamped recess in the second structural element.

6. A laundry washing machine according to claim 1, further comprising three or more of said sensing devices in between the suspension arrangement and the cylindrical housing.

7. A laundry washing machine according to claim 1, wherein the sensing device is a planar beam load cell.

8. A laundry washing machine according to claim 1, further comprising a door for gaining access to an interior of the drum, the door being suspended by the suspension arrangement.

9. A laundry washing machine according to claim 8, wherein the door is attached to the cylindrical housing.

10. A laundry washing machine comprising a cylindrical housing, a rotatable drum located within the cylindrical housing, a suspension arrangement carrying the cylindrical housing in relation to a base structure located under the washing machine and on which the washing machine rests, and a load sensing device configured to sense the load of the drum, a first structural element connected to the cylindrical housing, and a second structural element connected to the suspension arrangement, wherein the load sensing device is fitted between the first structural element and the second structural element, the load sensing device bridging a gap formed between the first and second structural elements.

11. A laundry washing machine comprising a cylindrical housing carried by a drum cradle arrangement, a rotatable drum located within the cylindrical housing, a suspension arrangement comprising a damper and carrying the cylindrical housing in relation to a base structure located under the washing machine on which the washing machine rests, and a load sensing device configured to sense the load of the drum; wherein the load sensing device is attached by a fastener to the drum cradle arrangement and is located on an opposite side of the suspension arrangement as seen from the base structure.

* * * * *